United States Patent [19]

Kahn

[11] 3,976,118

[45] Aug. 24, 1976

[54] METHOD FOR CASTING MATERIAL UNDER PRESSURE

[76] Inventor: Friedhelm Kahn, 2, Muhlbachstrasse, 6332 Ehringshausen, Germany

[22] Filed: Mar. 25, 1974

[21] Appl. No.: 454,422

Related U.S. Application Data

[62] Division of Ser. No. 225,512, Feb. 11, 1972, Pat. No. 3,814,170.

[30] Foreign Application Priority Data

June 8, 1971 Germany ..... 2128425

[52] U.S. Cl. ..... 164/119; 164/136

[51] Int. Cl.[2] ..... B22D 17/06

[58] Field of Search ..... 164/119, 309, 281, 80, 164/113, 120, 118, 316, 317, 318, 120 US, 251, 61, 65, 98, 91, 75, 58, 97, 62, 335, 320, 136, 314, 144 US

[56] References Cited

UNITED STATES PATENTS

| | | | |
|---|---|---|---|
| 1,403,955 | 1/1922 | Hill | 164/80 |
| 2,105,586 | 1/1938 | Daesen et al. | 164/113 |
| 2,195,360 | 3/1940 | Daesen | 164/113 |
| 2,660,769 | 12/1953 | Bennett | 164/156 |
| 2,683,294 | 7/1954 | Ennor et al. | 164/281 X |
| 3,430,685 | 3/1969 | Drugowitsch | 164/314 |
| 3,523,570 | 8/1970 | Groteke et al. | 164/320 X |

FOREIGN PATENTS OR APPLICATIONS

| | | | |
|---|---|---|---|
| 475,541 | 11/1937 | United Kingdom | 164/120 |

*Primary Examiner*—Ronald J. Shore
*Assistant Examiner*—Gus T. Hampilos
*Attorney, Agent, or Firm*—Gilbert L. Wells

[57] ABSTRACT

In a melting furnace the melting zone is sealed off from the air and a pipe is connected to the bottom of the melt, which pipe reaches outside the furnace with its upper end to the height of the molten material inside the furnace. The casting mold is arranged on the top of the pipe. An atmosphere of protective gas is established above the surface of the molten material in the furnace; the pressure of the protective gas being controlled by a special equipment. Casting is accomplished by introducing the material to be molten through a gas lock and through the protective gas atmosphere into the melt, causing the pressure inside the furnace to increase and forcing the molten material through the rising pipe into the mold. After the mold is filled the pressure of the gas is increased in order to feed the shrinkage and to achieve a fine grained and dense casting.

2 Claims, 2 Drawing Figures

METHOD FOR CASTING MATERIAL UNDER PRESSURE

This is a division of application Ser. No. 225,512, filed Feb. 11, 1972, now U.S. Pat. No. 3,814,170

BACKGROUND OF THE INVENTION

When pouring molten material into molds it is generally required that during the melting process and during the pouring no products form which may render the casting impure and which may unfavorably influence the structure of the casting, thereby preventing the casting from becoming a true to measurement workpiece upon solidification in the mold. And it is further required that the casting process is performed in an economical manner, preferably as much automated as possible.

In the known casting processes the melting and the pouring is usually done in successive operations, often at different places. For transporting the molten material to the mold the forces of gravity are utilized. During the transport the air can freely influence the material which causes a contamination mainly by the formation of oxides, nitrides and hydrogen. This may considerably lower the quality of the casting. For filling of the molds free from turbulence and for feeding the solidifying casting usually a considerable effort is required in the form of complicated filling and charging apparatuses which often fail to achieve the desired results. Many casting processes have become known which try to overcome these disadvantages. Some of the processes achieve at the same time a high degree of automation. It is also known that for special requirements the metal is molten in the furnace in a vacuum or under the cover of a protective gas. But when the furnace is recharged and when the melt is transported to the mold the influence of air on the melt cannot be avoided under shop conditions.

With the known low-pressure die casting process an almost turbulence-free filling of the mold and dense castings may be achieved with very little molten material needed. It is, however, a disadvantage of this process that the production must be stopped every time the furnace has to be recharged. The latter may be emptied only up to one third of the original charge. Owing to the oxidation of the molten material when being poured freely into the furnace the formation of scum cannot be prevented. For the same reason it is also practically impossible to melt additional solid material. The same dangerous effect occurs also in the rising pipe just below the mold. The effect is caused by the column of molten material which rises and recedes according to the cycles of casting operations. If high quality castings are to be produced the formation of scum must be prevented by inserting a sieving screen between the end of the rising pipe and the mold. It has also been suggested to overcome the disadvantages of the known casting processes by keeping the molten material after the casting operation on the level with the end of the rising pipe. However, this has proved to be very difficult on account of the constantly varying amount of molten material in the furnace. Further, the method has the disadvantage that for each casting operation a considerable amount of compressed gas is needed. For price reasons only compressed air can be used, which, if not carefully dried, may cause a contamination with hydrogen and may also cause the burn-out of such important components as magnesium and sodium. The air volume must be enlarged constantly with the decrease of the molten material in the furnace during the production. Together with the unavoidable thermal expansion of the air this leads to irregular filling conditions of the mold. A further disadvantage rests with the cast-iron rising pipe of which the durability is very limited, depending on the particular material which is molten and cast (see also the German periodical "GieBerei", 1969, Volume 4, page 83–90). The pressure exerted on the melt, which pressure is important for the density of the solidifying casting, must be kept at a low degree because it also effects the inner space of the whole furnace.

Further there are known a number of methods of automatically proportioning the molten metal for the molds or for pressure die casting machines, which methods make use of various valve and pump systems. But they all have the drawback that the air will come into contact with the molten material during the casting process, which results in the above mentioned disadvantages (see also the German periodical "GieBerie", 1962, Volume 8, page 180–189 and Volume 14, page 391–395 and page 400–402).

Further in this connection, there must be mentioned proportioning methods using solid charging material, such as pigs or continuous cast ingots, for displacing molten material out of the furnace. But here again the contact with the air cannot be prevented and, moreover, these methods can only be used with specific types of alloys (see also DBP 1,263,995, further see German periodical "GieBerie", 1968, Volume 25, page 765–768 and volume 18, page 557).

It is therefore an object of the invention to suggest a novel method of melting material and producing high quality castings in an economical manner. It is an other object to suggest a method by which the disadvantages of the prior art methods are overcome. And it is a further object of the invention to provide a furnace for performing the new method.

SUMMARY OF THE INVENTION

According to the invention the above stated objects are attained by a method of melting charging material in a pressure-tight furnace under a cover of protective gas and by using the overpressure developed mainly thereby for displacing molten material out of the furnace. Preferably the furnace used is an induction furnace having an airtight or gastight charging portion and comprising a pipe which rises on one side of the furnace from the furnace bottom. The rising pipe can be heated and is, of course, used for casting the molten material into the mold.

The charging portion of the furnace is formed by a pressuretight chamber into which the material to be molten is introduced in the form of solid elements having a shape suitable for sealing off the chamber. In its upper part the chamber is sealed off by means of a suitable sealing and in its lower part by the molten material itself. In both parts the sealing becomes effective between the chamber wall and the charging material. The chamber is filled with a protective gas or with a gas which has some sort of metallurgical effect. In accordance with the amount of solid material introduced into the furnace the gas is maintained at the pressure required for proper filling and feeding by means of a special pressure control system.

The gas filling is preserved throughout a longer period of time, i.e. throughout several casting cycles; only losses by leakages must be replaced.

In order to avoid any noticeable loss of heat out of the melting zone of the furnace by way of the solid charging material the latter is subdivided into smaller pieces which are interconnected by elements having only little heat conductivity. A special conveyor system is provided which transports the charging material into the pressure chamber and into the melt in the furnace. The introduction of air into the pressure chamber, which could easily occur at the places of interconnection of two adjacent charging pieces, is prevented with the help of a flush nozzle which sprays the same gas that is used as the protective gas. The charging portion of the furnace is sealed off from the melting zone by a gastight inset element up to which the level of the molten material reaches.

Further, the charging portion of the furnace is provided with an opening for filling additives into the melt, as for example substances for achieving a fine grain. This opening is also provided with a seal. Also, the temperature may be measured through such an opening; and further, melt can be filled in here.

The invented method of producing castings is started by transporting, by means of the conveyor system, the charging material into the melt to such an extent that the introduced volume of the charging material corresponds to the volume of the casting to be produced. Prior to the beginning of the operation the normal level of the melt in the furnace corresponds of course to the upper end of the rising pipe. On account of the increase of the pressure in the charging portion, which pressure is in addition regulated through the pressure control system, the melt rises out of the rising pipe into the mold. After the mold has been filled the pressure is further increased through the solidification period in order to achieve a dense casting, and this increased pressure is maintained until the front zone of solidification approaches the upper end of the rising pipe Subsequently the pressure control system regulates the pressure to the normal value so that the mold may be opened for extracting the casting in the case of the permanent mold process, or that the filled mold may be replaced by an empty one. During this phase of operation the new portion of the charging material transported into the melt is molten.

The new method has mainly the advantage that the melt obtained under the protective gas is free from contamination, which melt is cast by the apparatus into true-to-measurement workpieces. The melt enters the mold from below in a turbulence-free flow and solidifies mainly in the direction from the top to the bottom so that an especially dense and perfect casting is obtained. At the same time very little additional material is needed in the form of gating and feeding system.

Owing to the practically constant level of molten material in the furnace, caused by the introduction of solid material interrelated with the casting process, a high degree of homogeneousness in filling the molds is achieved through numerous casting cycles. Limiting the gas pressure to the charging portion of the furnace makes the furnace less expensive and allows the employment of a considerably higher pressure, as compared to the prior art methods. The higher pressure is advantageous for a dense solidification of the casting. Since, contrary to the prior art methods, a change of the protective gas with every casting cycle is avoided, a protective gas, such as argon, may economically be used. Thereby not only a contamination of the melt is avoided but also a loss of material by oxidation in the furnace.

The introduction of additives into the melt is possible without interrupting the continuous production process. The new casting method is applicable with nearly all material which can be molten and cast and difficulties caused by the rising pipe, as are encountered with the low pressure die casting method, do not occur. The method is also generally applicable if castings of a larger volume are to be produced, and also in mass production of small size castings. Even sand castings of extreme size and volume may be produced according to this method and, due to the very exact proportioning of the material displaced from the furnace, the method is also suitable for the permanent mold process and high pressure die casting. The high degree of mechanisation entails a saving of both energy and material. The melting of compact charging elements, such as continuous cast ingots, is much more economical than the melting of pigs, mainly because in the melting house no mixing of alloying constituents is required, this work being left to only a few larger smelteries. The atmosphere in the melting house is improved by melting the material in a tightly closed furnace. This also helps to prevent air pollution.

The new method described works on the condition that the material to be molten is introduced into the heated furnace in solid form and molten therein. These steps are required and advantageous if the foundry receives its raw material in solid form. If, however, a melting house is located close by the foundry it is advantageous to work with the same apparatuses and, at least partially, according to the same method. This requires an introduction of the material to be cast into the furnace in a molten state and a generation of the pressure needed for casting by different means.

In a further embodiment of the invention it is therefore suggested first to introduce the melt into the furnace and then to lower a displacing element in the charging portion of the furnace, which displacing element takes the place of the previously used charging material. The pressure whichh is thus generated forces the melt through the rising pipe into the mold. When the molten material is cast into the furnace it will, of course, be advantageous to lift the displacing element out of the furnace. The molten material may be poured into the furnace through the opening provided in the furnace for adding the additives to the melt, or it may be poured through the rising pipe. In a different embodiment, however, the furnace may be provided with a separate valve-controlled channel near the furnace bottom through which the molten material may flow into the furnace.

The displacing element consist of a material resistent to the heat and also against the attack of the melt. Further, the displacing element may be provided with its own heat source in its interior, or it may be heated by induction from the outside.

After the molten material has been introduced into the furnace the melt may be degassed prior to casting by evacuating the charging portion of the furnace.

Depending on the size of the furnace and on the number of the workpieces to be cast the molten material may be poured into the furnace after every casting process. To this end the displacing element is lifted by the height of the previously cast volume and a corresponding amount of molten material is brought into the furnace by one of the above described ways.

In another embodiment for filling the furnace with molten material after each casting cycle, the displacing element is lifted to such an extend that the space becoming vacant thereby corresponds exactly to the amount of material displaced into the mold, and that at the same time new molten is filled into the furnace.

In yet another embodiment, the displacing element is lowered into the furnace through a number of casting cycles until the furnace is practially emptied from the molten material, and wherein thereafter the displacing element is lifted completely for filling the furnace with new molten material by one lifting operation.

BRIEF DESCRIPTION OF THE DRAWINGS

The invention will be more readily comprehended from the following description when taken in conjunction with the appending drawings, wherein.

DESCRIPTION OF THE PREFERRED EMBODIMENTS

Figure 1:
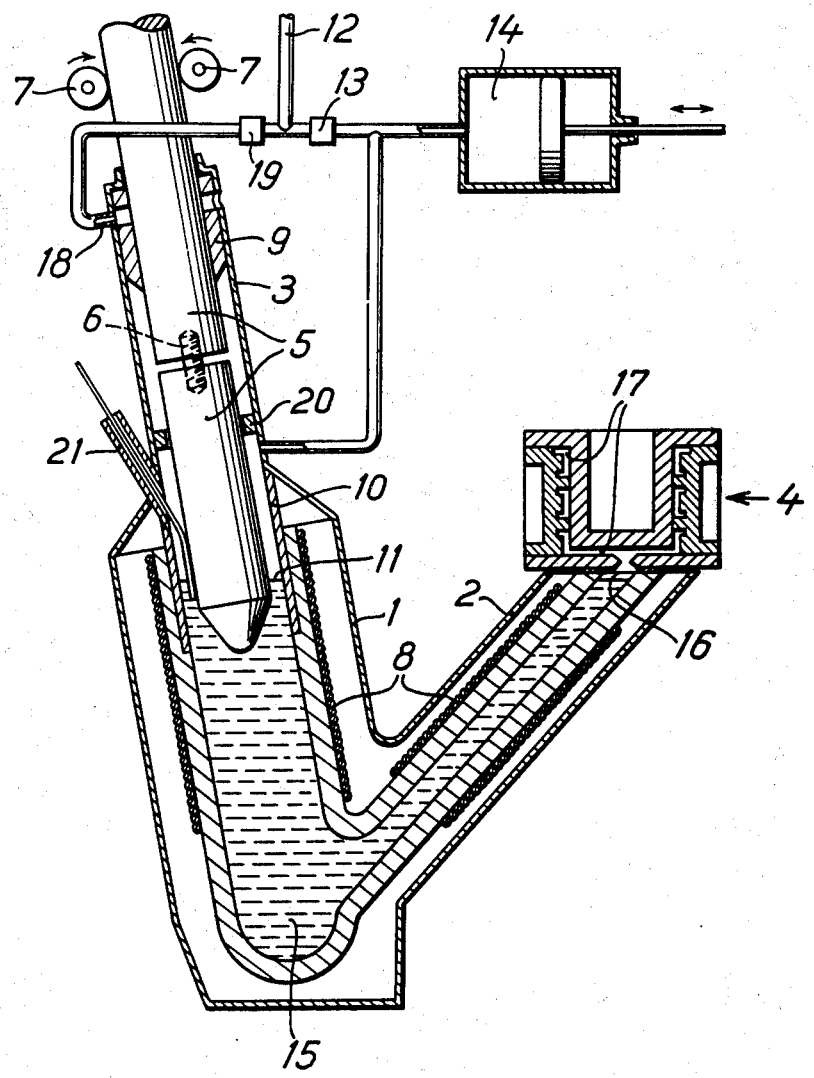
FIG. 1 is a cross-sectional view of a first embodiment of a furnace for performing the invented casting method.

Referring now to the drawings, the embodiment shown in FIG. 1 comprises mainly an induction furnace 1 provided on one side with a rising pipe 2, and further provided with a gastight charging portion 3. The mold is designated by the numeral 4. The charging portion 3 is made gastight relative to the outside by means of a suitable sealing 9 and relative to the furnace 1 by means of an inset 10 made of a gastight, heat resistant material and by the surface of the melt 11 is this area. Above the sealing 9 there is arranged a gas nozzle 18 which may be connected to a gas source 12 by way of a valve 19. The charging portion 3 is connected to a pressure cylinder 14 and contains a protective gas, e.g. argon, which is also introduced through the gas source 12 and a valve 13. The gas is controlled to the various pressures required during the casting process in accordance with the lowering of the charging element 5 by the pressure cylinder 14. The charging element 5 consists, for example, of continuously cast ingots which are separated from one another by narrow gaps and mechanically interconnected across the gaps by threaded bolts 6 of similar material. Controllable, motordriven conveying pulleys 7 transport the charging elements 5 through the charging portion 3 for melting into the area of the induction coil 8 in the furnace 1.

Casting may begin as soon as the melt 15 in the furnace has risen to its normal level, which is up to the upper end 16 of the rising pipe 2. The lowering of the charging element 5 into the melt causes the melt 15 to rise above its normal level. But only in the rising pipe 2, because in the charging portion 3 a counter pressure is generated by the gas controlled by the pressure cylinder 14. The counter pressure keeps the melt level in the charging portion at its normal height, i.e. at the height of the inset 10. The melt 15 is displaced through the ending 16 of the rising pipe 2 into the space 17 of the mold 4 and fills this space. When the mold is filled the charging element 5 comes to a standstill. A further increase of the gas pressure improves the feeding and consequently the density of the solidifying casting in the mold 4.

As soon as the solidification has progressed close to the upper end 16 of the rising pipe 2 the gas pressure in the charging portion 3 may be reduced to normal and the mold may be opened for taking out the casting, or the mold may be replaced by an empty one for a new casting cycle. In order to prevent the penetration of air into the charging portion of the furnace, gas is pumped through the nozzle 18 by way of the valve 19 whenever a gap between two charging elements 5 passes in front of the nozzle. In the interior of the charging portion 3 the elements are guided by a ring 20. The sealed-off conveying device 21 allows for the introduction of additives in wire-form into the melt without disturbing the casting process.

Figure 2:
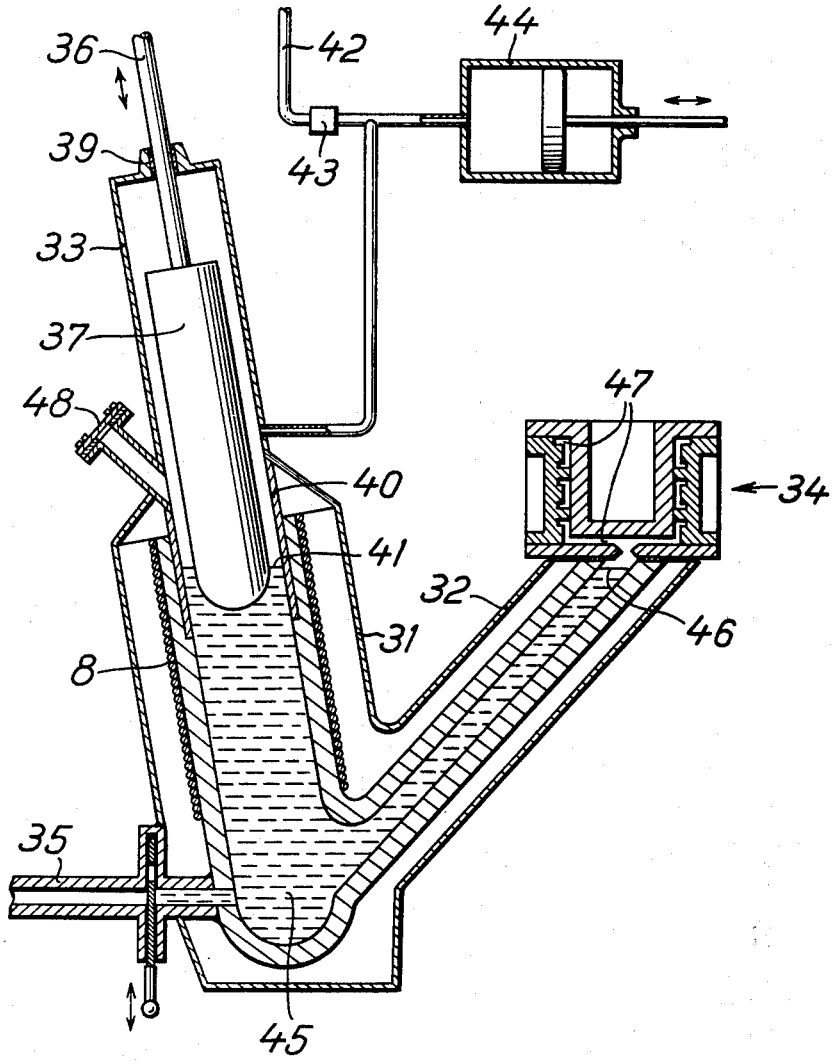
FIG. 2 is a cross-sectional view of a second embodiment of a furnace for performing the invented casting method.

The device illustrated in FIG. 2 comprises mainly the furnace 31 (as does the embodiment shown in FIG. 1) having on one side a rising pipe 32 with the mold 34, and also having a charging portion 33. The latter is sealed-off from the atmosphere by means of a sealing 39 and from the melting zone of the furnace by means of the gastight, heat resisting inset 40 and also by the surface 41 of the melt in this area. The charging portion 33 is connected to the pressure cylinder 44 and contains a protective gas, e.g. argon, which comes from a gas source 42 by way of a shut-off valve 43. The gas is regulated to the various pressures required during the casting process by the pressure cylinder 44 in accordance with the lowering of the displacing element 37.

The displacing element 37 consists of a material resistant against the heat of the furnace and also against the attack of the melt. The element may be provided with its own heat source, either a heat source installed in its interior or it may be warmed up by induction heating from the outside, and it may be used for additionally heating up the melt. The displacing element 37 is suspended and operated in the manner required by the different steps by a lifting and lowering device 36.

For a casting process the furnace is first filled with the melt 45, either by way of the valve-controlled channel 35 or through the opening 48 for introducing additives, or through the open end of the rising pipe 46. If the melt is to be introduced through the rising pipe 46 the mold 34 must be removed prior to filling. The filling process can be performed rather turbulence-free under the cover of the protective gas if the displacing element, which has previously been completely lowered into the furnace, is lifted slowly upwards during the filling process by the lifting and lowering device.

The casting cycle may begin as soon as the melt 45 in the furnace 31 has reached its normal level in the area of the inset 40, which level corresponds to the height of the end 46 of the rising pipe 32. A lowering of the displacing element 37 into the melt 45 causes the latter to rise above the normal level, but only in the rising pipe 32 because at the same time there is generated a gas counter pressure in the charging portion 33 by means of the pressure cylinder 44 which here keeps the level of the melt at the height of the normal level, i.e. in the area of the inset 40.

The melt is displaced through the end 46 of the rising pipe 32 into the space 47 of the mold 34 and fills this space. When the mold is filled the displacing element 37 is brought to a rest. A further increase of the pressure with the help of the pressure cylinder 44 improves the feeding and consequently the density of the solidifying casting in the mold 34. As soon as the solidification has progressed to the area of the end 46 of the rising pipe 32 the pressure in the charging portion 33 may be reduced to normal. The mold 34 may then be opened for extracting the casting, or the mold may be replaced by an empty one for the next casting cycle. In case the casting is performed continuously into a die for continuous casting the process may be carried on until the furnace 31 is completely empty.

The above describes only one casting cycle. In case the furnace has a bigger volume the next casting cycle and any further cycle is started by further lowering the displacing element. In case of a smaller furnace there is the possibility of lifting the displacing element at the end of every casting cycle to its starting position and, at the same time, to refill the melt into the furnace.

What is claimed is:

1. A method of melting material and casting workpieces, comprising the steps of:

a. continuously introducing material to be melted into a gastight chamber of a furnace through a gas lock;

b. heating said material in said furnace for melting;

c. generating a pressure inside said furnace both by said introducing material to be melted and increasing the gas pressure in the gastight chamber of said furnace by means of a closed pressure system outside of said gastight chamber;

d. displacing said melt through a pipe connected with said furnace to the bottom of a connected mold for filling and feeding from below;

e. keeping the melt in said furnace at a nearly constant level during all casting cycles and sealing the lower part of the gastight chamber by keeping said melt in contact with a gastight refractory insert which forms the upper part of said furnace; and f. keeping the melt in said pipe at a level near the upper end of said pipe after the gas pressure is reduced for opening or changing the mold.

2. The method of claim 1, wherein said gas is a protective gas operating in a closed pressure system with very small leakage.

* * * * *